United States Patent [19]

Mangus

[11] 4,082,224

[45] Apr. 4, 1978

[54] FUEL INJECTION NOZZLE

[75] Inventor: Ervin E. Mangus, Brimfield, Ill.

[73] Assignee: Caterpillar Tractor Co., Peoria, Ill.

[21] Appl. No.: 730,492

[22] Filed: Oct. 7, 1976

[51] Int. Cl.[2] ..... B05B 1/14

[52] U.S. Cl. ..... 239/453; 137/542; 239/533.12

[58] Field of Search ..... 239/453, 533.12, 464, 239/452, 460; 137/540, 542

[56] References Cited

U.S. PATENT DOCUMENTS

| | | | |
|---|---|---|---|
| 1,065,971 | 7/1913 | Severin | 239/453 X |
| 1,758,119 | 5/1930 | LeMoon | 239/453 X |
| 2,555,803 | 6/1951 | Mashinter et al. | 239/533.12 X |
| 2,820,673 | 1/1958 | Zubaty | 239/453 |
| 3,032,279 | 5/1962 | Czarnecki | 239/464 |
| 3,727,636 | 4/1973 | Simmons | 239/453 X |

*Primary Examiner*—Joseph F. Peters, Jr.
*Assistant Examiner*—Michael Mar
*Attorney, Agent, or Firm*—Wegner, Stellman, McCord, Wiles & Wood

[57] ABSTRACT

A fuel injection nozzle for engines or the like, including a nozzle barrel and device for delivering fuel to the interior of the barrel. A fuel delivery port is disposed on one end of the barrel and a poppet valve seat is located on the end of the barrel concentric with the port. A poppet valve is seatable against the valve seat to close the port and a valve stem extends through the port into the barrel and has the poppet valve mounted on one end. The port serves as a guide for the stem for reciprocating movement of the stem within the barrel and there are provided a plurality of angularly spaced, longitudinal grooves in at least the valve stem. The grooves are dimensioned so as to extend past the valve seat when the poppet valve is open to provide plural fuel conduits for the flow of fuel from the barrel into a combustion chamber or the like and to be sealed by the valve and the valve seat when the valve is closed to prevent exposure of fuel therein to gases of combustion to thereby prevent vaporization of such fuel and the resultant substantial hydrocarbon emissions.

5 Claims, 9 Drawing Figures

22
24
14
10
26
18
16
20
12

32
52
30
52
40

30
34
36
54
52

3.
52
46
48
34
42
40
36
52
38
32
30
44
50
3.

30
56
36
52

40
38'
52
36
34'

SPRAY PATTERN EXAMPLE
DEEP PENETRATION
SHALLOW PENETRATION
INJECTOR TIP
INJECTION PATTERN 9.
40
30
34
36
52
38
9.

32
30
52
52
40

FUEL INJECTION NOZZLE

BACKGROUND OF THE INVENTION

This invention relates to fuel injection devices. More specifically, it relates to fuel injection nozzles of the so-called "zero sac" variety.

Prior art of possible relevance includes the following U.S. Pat. Nos. 3,039,701 issued June 19, 1962 to Carlisle; 3,093,317 issued June 11, 1963 to Simmons et al; and 3,578,249 issued May 11, 1971 to Davis.

Increasing concern in recent years over emissions from internal combustion engines has resulted in an increase in the popularity of so-called "zero sac" fuel injection nozzles in engines employing fuel injection inasmuch as they tend to promote more complete combustion and, therefore, minimize the emission of hydrocarbons. Fuel injection nozzles of the non-zero sac type allow a small volume of fuel to remain in the nozzle between the usual check valve and the outlet end of the spray orifices. Such fuel does not participate in the combustion process but, rather, tends to evaporate during later stages of the combustion cycle due to exposure to the hot gases of combustion. As a consequence, such vaporized fuel will be emitted from the engine in an unburned state, i.e., as hydrocarbons.

One type of injection nozzle known in the art utilizing a pintle valve, as, for example, the construction disclosed in the above identified Simmons et al patent, eliminates the problem in that a valve seats against the outlet end of the fuel delivery port, preventing any fuel from being directly exposed to the hot gases of combustion. However, such nozzles produce but one fuel jet rather than several. As a result, much swirl is required in the combustion chamber of the engine to achieve good mixing of air with the fuel to obtain optimum combustion.

In engines having minimal swirl, i.e., quiescent engines, such nozzles cannot be utilized unless more than one is employed since good mixing cannot be obtained with but a single nozzle with the result that combustion conditions are not optimal with the result that considerable unburned fuel will be emitted as hydrocarbons.

Consequently, such nozzles cannot be advantageously employed with all engine designs or must be multiplied in number with the resulting attendant expense.

SUMMARY OF THE INVENTION

It is the principal object of the invention to provide a new and improved fuel injection nozzle. More specifically, it is an object of the invention to provide such a nozzle wherein hydrocarbon emission in an engine in which the nozzle is used may be minimized and wherein the nozzle is adapted for use in a variety of engine designs including those having low swirl characteristics in an economically feasible manner.

An exemplary embodiment of the invention achieves the foregoing objects in a fuel injection nozzle having a nozzle barrel adapted to receive fuel under pressure and terminating at one end in a reduced diameter bore. A poppet valve seat is formed on the end and is generally concentric with the bore. A valve stem is located in the barrel and slidably extends through the port. The valve stem has a diameter substantially equal to that of the reduced diameter bore to be supported thereby for substantially only reciprocating motion. A poppet valve is carried by the stem in alignment with the valve seat for sealing engagement with the valve seat and there are located a plurality of angularly spaced fuel conducting channels carried by the stem which open past the bore and the valve seat when the stem is reciprocated to open the poppet valve. As a consequence, there are approximately as many spray patterns as there are channels to provide a multi-spray effect with a single nozzle while the use of the poppet valve construction precludes exposure of unvaporized fuel to hot gases of combustion, thereby minimizing hydrocarbon emissions.

In a highly preferred embodiment, the fuel conducting channels are in the form of longitudinal grooves in at least the valve stem.

The poppet valve and valve seat may be of any desired configuration, but generally will be either conical or spherical.

Preferably, one or the other, or both, of the poppet valve and the stem have lapped surfaces to provide for positive sealing. In a highly preferred embodiment, the clearance between the valve stem and the bore is no more than about 0.0001 inches.

According to one embodiment of the invention, the grooves in the stem are equally angularly spaced on the stem and have ends adjacent the poppet valve which are equidistant from the poppet valve to provide a uniform fuel spray pattern.

In another embodiment of the invention, the grooves are non-equally angularly spaced about the stem to provide a desired asymmetrical fuel spray pattern.

In still another embodiment, the ends of the grooves adjacent the poppet valve are located at predetermined, differing distances from the poppet valve to provide a desired asymmetrical fuel pattern.

Other objects and advantages will become apparent from the following specification taken in connection with the accompanying drawings.

DESCRIPTION OF THE PREFERRED EMBODIMENTS

Figures 1, 2, 3, 4, 5, 6, 7, 8, 9:
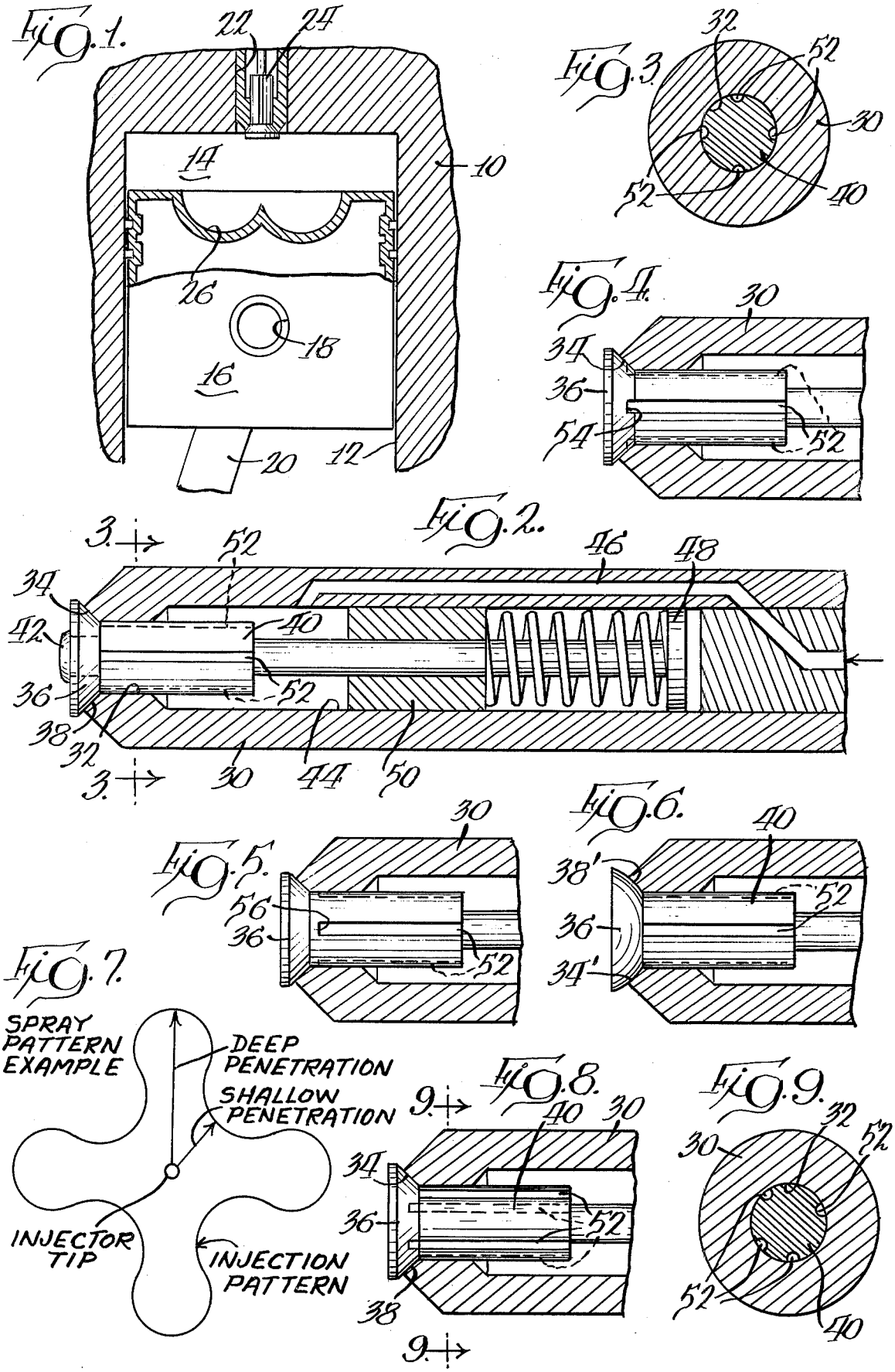
FIG. 1 is a sectional view of one cylinder of an internal combustion, reciprocating engine employing a fuel injecting nozzle made according to the invention.
FIG. 2 is an enlarged, fragmentary sectional view of one embodiment of the fuel nozzle.
FIG. 3 is a sectional view taken approximately along the line 3—3 in FIG. 2.
FIG. 4 is a view similar to FIG. 2, but of a modified embodiment of the invention.
FIG. 5 is a view similar to FIG. 2, but of still another modified embodiment of the invention.
FIG. 6 is a view like FIG. 2, but still a further modified embodiment of the invention.
FIG. 7 is a somewhat schematic view of a spray pattern obtained with a nozzle of the type illustrated in FIG. 2.
FIG. 8 is a view like FIG. 2, but of still another modified embodiment of the invention.
FIG. 9 is a sectional view taken approximately along the line 9—9 in FIG. 8.

Fuel injection nozzles made according to the invention are intended for use in fuel consuming devices as, for example, a reciprocating internal combustion engine as illustrated in FIG. 1. The engine includes a housing 10 having an interior cylinder 12 defining a working chamber 14. A piston 16 is mounted by a wrist pin 18 on a connecting rod 20 which extends to a crank shaft (not shown) in a conventional fashion.

The upper end of the housing 10 is provided with an opening 22 in which the fuel injection nozzle 24 is received whereby fuel may be injected into the working chamber 14 above the crown of the piston 16. If desired, the crown of the piston 16 may be provided with a crater 26 of any suitable design for the usual purposes.

One embodiment of a fuel injecting nozzle made according to the invention is illustrated in FIGS. 2 and 3 and is to include an elongated nozzle barrel 30 which may be received in the opening 22. One end of the barrel 30 includes a reduced diameter bore 32 which is surrounded by an annular valve seat 34. In the embodiment illustrated in FIGS. 2 and 3, the valve seat 34 is frusto-conical in shape.

A poppet valve 36 is provided in alignment with the valve seat 34 and includes a frusto-conical surface 38 which is formed to mate with the seat 34. A valve stem 40 is disposed within the barrel 30 and extends through the bore 34 to receive, on one end, the poppet valve 36. If desired, the stem 40 and the valve 36 may be integrally formed. Alternately, they may be formed as separate elements with the poppet valve 36 being secured to the stem 40 by means of a rivet 42 or other suitable securing device.

The bore 32 serves as a guide for the stem 40 during reciprocation thereof. Preferably, the dimensioning of the two is such that the stem 40 can substantially undergo only reciprocating, slidable movement within the bore 32. In this respect, it is highly desirable that the clearance between the bore 32 and the stem 40 be no greater than 0.0001 inches.

Remote from the bore 32, the interior wall 44 of the barrel 30 is spaced from the stem 44 to define a space for receipt of fuel to be injected through the nozzle. A passage 46 may be provided in one side of the barrel 30 (either interiorly or exteriorly, as desired) to receive fuel from a conventional plunger pump (not shown) or the like.

The end of the stem 40 remote from the poppet valve 36 is provided with a cap 48 and the interior of the barrel 30, at a location between the bore 32 and the cap 48, includes a guide 50 which also slidably receives the stem 40. A biasing spring 52 is interposed between the guide 50 and the cap 48 to bias the poppet valve 36 and the stem 40 towards a closed position.

As seen in FIGS. 2 and 3, the portion of the stem 40 adjacent the poppet valve 36 is provided with a plurality of longitudinally extending grooves 52. The grooves 52 define fuel conducting channels from the interior of the barrel 30 and are dimensioned such that they open beyond the bore 32 and the valve seat 34 when the stem 40 and poppet valve 36 are moved to the left from the position illustrated in FIG. 2 corresponding to an open position. Fuel delivered to the interior of the barrel 30 by the path previously described will be ejected from the exposed ends of the grooves 52 which extend past the seat 34. It is to be noted that the length of the grooves 52 is such that the right-hand ends of the same, as viewed in FIG. 2, would be in fluid communication with the interior of the barrel 30 even for the most open position of the poppet valve 36.

As illustrated in FIGS. 2 and 3, the grooves 52 are equally angularly spaced about the stem 40 and have their ends equidistant from the poppet valve 36. This promotes the uniform spray pattern, such as that illustrated in FIG. 7, having fuel penetration as illustrated in FIG. 7. Dispersion characteristics will generally be inverse to the penetration characteristics indicated. Thus, the fuel injection nozzle illustrated in FIGS. 2 and 3 generates, in effect, four individual sprays so that one fuel injection nozzle can provide the spray pattern heretofore requiring the presence of four injection nozzles.

Of course, greater or lesser numbers of the grooves 52 may be employed as desired.

Fuel flow rates in a fuel injection nozzle made according to the invention can be controlled in any of a variety of ways. For example, it may be controlled by suitably selecting the width and depth of the slots 52. Alternately, it can be controlled by the area of the grooves 52 that extend past the seat 34 when the valve is open. It may also be controlled by appropriate configuration of the poppet head.

In FIG. 4, there is illustrated an embodiment wherein the grooves 52 have their ends 54 adjacent the poppet valve head, actually extending into the poppet valve head a short distance. Of course, the arrangement is such that the poppet will still completely close against the seat. In the embodiment illustrated in FIG. 4, fuel flow is controlled by the poppet head.

In FIG. 5, the ends 56 of the grooves 52 adjacent the poppet valve 36 do not extend to the edge of the poppet valve as is the case with FIG. 2, but are spaced therefrom. In this embodiment, fuel flow will generally be governed by slot size and geometry.

FIG. 6 illustrates a modified embodiment of the invention wherein the seat 34' is concave and spherical whereas the surface 38' of the poppet valve 36 is convex and spherical in lieu of the conical configurations mentioned previously. In some instances, the arrangement illustrated in FIG. 6 is preferred as providing more positive sealing.

FIG. 8 illustrates an embodiment of the invention whereby an asymmetrical spray pattern may be obtained. In the embodiment of FIG. 8, the ends of the grooves 52 adjacent the poppet 36 are spaced unequal distances from the poppet 36. In addition, as seen in FIG. 9, the grooves 52 are not equally angularly spaced about the stem 40. It is to be specifically noted that the features of differing locations of the ends of the grooves 52 and unequal angular spacing of the grooves can be used together or separately to provide an asymmetrical spray pattern. The use of different locations of the ends of the grooves 52 will result in lesser fuel flow through those grooves having their ends more remote from the poppet valve 36 than others with a corresponding change in penetration and dispersion. Those grooves having their ends more remote from the poppet valve 36 will tend to generate sprays having less penetration and more dispersion than those having their ends closer to the poppet valve 36.

Non-equal angular spacing of the grooves 52 will alter the angular location of the zones of deep penetration and corresponding dispersion characteristics from that illustrated in FIG. 7 approximately according to the particular angles between the grooves involved.

Dispersion and penetration characteristics can also be suitably altered by appropriately selecting the width of the valve seat 34, that is, the dimension between the inner and outer diameters of the valve seat 34. For small widths, greater dispersion will be obtained than for relatively larger widths and it is also envisioned that the width of the valve seat 34 may be varied about its periphery to provide non-uniform dispersion characteristics as desired for particular applications.

In general, it is highly desirable that the surface 38 on the poppet 36 or the surface of the stem 40 be lapped in place according to conventional practice to achieve good close fits, as mentioned previously, and provide for extremely positve sealing.

If desired, the longitudinal slots may be linear, as illustrated, or assume other configurations, as, for example, helical.

Valve opening and closing may be controlled by suitably regulating the fuel pressure which acts against the constant spring force provided by the spring 52. Similarly, the orifice area, and thus fuel flow rate may be varied by suitably varying fuel pressure.

From the foregoing, it will be appreciated that a fuel injection nozzle made according to the invention prevents direct exposure of unvaporized fuel to hot gases of combustion which could cause such fuel to vaporize and generate undesirable hydrocarbon emissions. At the same time, it will be appreciated that a single nozzle made according to the invention can be used in engines or the like of varying designs, generally irregardless of their varying swirl characteristics, eliminating the need for plural nozzles, or plural apertured nozzles heretofore required.

What is claimed is:

1. A fuel injection nozzle comprising:

a nozzle barrel;

means for delivering fuel to the interior of said barrel;

a fuel delivery port on one end of said barrel a poppet valve seat on said one end of said barrel and generally concentric with said port;

said nozzle one end being adapted to be received within a combustion chamber or the like and being free of structure surrounding said valve seat;

a poppet valve seatable against said valve seat to close said port;

a valve stem extending through said port into said barrel and having said poppet valve mounted on one end of said stem;

said port slidably engaging said stem to act as a guide for said stem for reciprocating movement of said stem within said barrel; and a plurality of angularly spaced longitudinal grooves in said valve stem and terminating short of said poppet valve, said grooves being dimensioned so as to extend past said valve seat when said poppet valve is opened to provide plural fuel conduits for the flow of fuel in plural streams from said barrel into a combustion chamber or the like and to be sealed by said valve and said valve seat when said valve is closed to prevent vaporization of such fuel and substantial hydrocarbon emissions, said grooves constituting the sole passageway for fuel flow past said valve seat.

2. The fuel injection nozzle of claim 1 wherein said grooves are equally angularly spaced on said stem and have ends adjacent said poppet valve equidistant from said poppet valve to provide a uniform fuel spray pattern.

3. The fuel injection nozzle of claim 1 wherein said grooves are non-equally angularly spaced about said stem to provide a desired asymmetrical fuel spray pattern.

4. The fuel injection nozzle of claim 1 wherein the ends of said grooves adjacent said poppet valve are located at predetermined, differing distances from the poppet valve to provide desired asymmetrical fuel spray pattern.

5. An internal combustion engine having a housing defining a working chamber and having an opening extending into said working chamber, the fuel injection nozzle of claim 1 being disposed in said opening.

* * * * *